United States Patent [19]

van Tilburg, deceased et al.

[11] 4,432,926

[45] Feb. 21, 1984

[54] METHOD AND APPARATUS FOR IMPARTING TWO-WAY PROPERTIES TO FLEXIBLE WEBS

[75] Inventor: Jan van Tilburg, deceased, late of London, England; by Yolande Eve van Tilburg, London, England, administration

[21] Appl. No.: 287,729

[22] PCT Filed: Nov. 24, 1980

[86] PCT No.: PCT/GB80/00202

§ 371 Date: Jul. 22, 1981

§ 102(e) Date: Jul. 22, 1981

[87] PCT Pub. No.: WO81/01426

PCT Pub. Date: May 28, 1981

[30] Foreign Application Priority Data

Nov. 23, 1979 [GB] United Kingdom ..... 7940516

[51] Int. Cl.[3] ..... B29C 17/00; D06C 21/00

[52] U.S. Cl. ..... 264/282; 26/18.6

[58] Field of Search ..... 264/282; 26/18.6

[56] References Cited

U.S. PATENT DOCUMENTS

| | | | |
|---|---|---|---|
| 3,100,925 | 8/1963 | Messinger | 26/18.6 |
| 3,260,778 | 7/1966 | Walton | 264/282 |
| 3,476,644 | 11/1969 | Krehnbrink | 264/282 |
| 3,810,280 | 5/1974 | Walton et al. | 264/282 |
| 3,869,768 | 3/1975 | Walton et al. | 264/282 |

*Primary Examiner*—James B. Lowe

*Attorney, Agent, or Firm*—Scully, Scott, Murphy & Presser

[57] ABSTRACT

A method for the longitudinal compressive treatment of a flexible web, e.g. of paper or textile material, in which the web is continuously driven longitudinally into and through a retarding treatment zone defined by and between a pair of opposed surfaces at least one of which is stationary and rough and retardingly engages the web, the value of the retarding force applied to the web over at least a part of the length of the retarding treatment zone varying in oscillatory fashion across the width of the zone so that the treatment improves or provides a directional property (e.g. stretch) of the web in both the longitudinal and transverse directions. In machines for obtaining this effect, the degree of roughness of retarder surface to which the web is subjected in the zone suitably so varies across the zone.

15 Claims, 12 Drawing Figures

FIG. 1
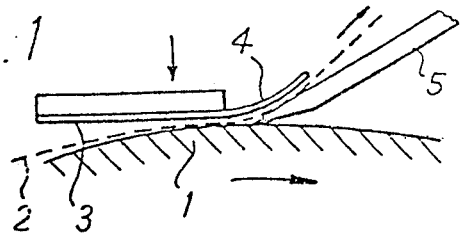
FIG. 2
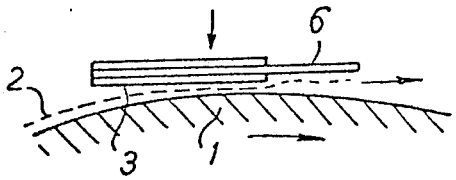
FIG. 3
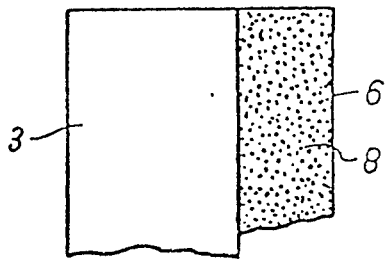
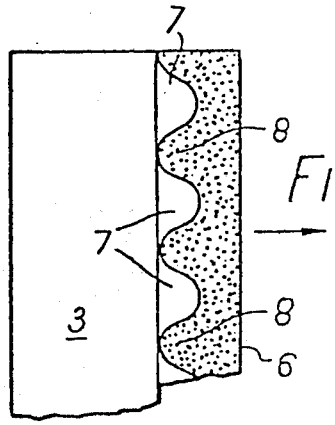
FIG. 4
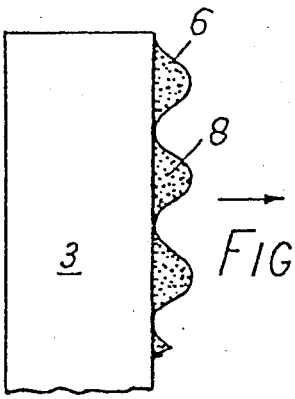
FIG. 5
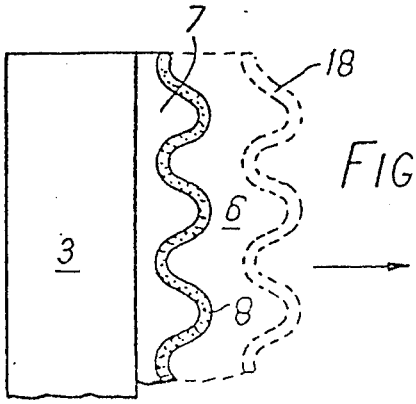
FIG. 6

METHOD AND APPARATUS FOR IMPARTING TWO-WAY PROPERTIES TO FLEXIBLE WEBS

This invention relates to the longitudinal compressive treatment of flexible textile and other webs, e.g. woven, knitted and non-woven fabrics, paper, foil and film.

Such treatment methods and machines are known and used for improving web properties such as softness, cover, stretchability, drape etc.; machines which can accomplish such improvements are described, for example, in U.S. Pat. Nos. 3,260,778 and 3,810,280. Heretofore, however, it has not been possible satisfactorily to improve or impart directional web properties (e.g. stretch) both in and across the machine direction; attempts to obtain or improve such two-way properties have generally necessitated sequentially applying two separate treatments and have been commercially unsuccessful.

The present invention provides a method and apparatus by which a two-way property can be improved in or imparted to a flexible web in a single operation. Particularly preferred applications of the invention impart two-way stretch to the web in a single machine pass.

According to the invention there is provided a method for the longitudinal compressive treatment of a flexible web, in which the web is continuously driven longitudinally into and through a retarding treatment zone defined by and between a pair of opposed surfaces at least one of which is stationary and rough and retardingly engages the web, the retarding force applied to the web over at least a part of the length of the retarding treatment zone oscillating across the width of the zone so that the treatment improves or provides a directional property of the web in both the longitudinal and transverse directions. For performing this method, the invention also provides apparatus for the longitudinal compressive treatment of a flexible web, the apparatus comprising a retarding treatment zone defined by closely spaced opposed surfaces at least one of which is stationary for retardingly engaging a web passing through the zone, and drive means for continuously driving a flexible web longitudinally into and through the retarding treatment zone, the roughness of said one surface over at least a portion of the length of the retarding treatment zone oscillating across the width of the zone; a modification of this apparatus comprises a retarding treatment zone defined by closely opposed surfaces at least one of which is stationary for retardingly engaging a web passing through the zone, and drive means for continuously driving a flexible web longitudinally into and through the retarding treatment zone, the said one surface being rough at least over its downstream end which terminates at a non-rectilinear transverse edge so that the retarding force applied in operation by the rough surface portion oscillates across the width of the retarding treatment zone.

Preferably the web is driven into the retarding treatment zone by a drive surface onto which the web is pressed by a confining surface. In some cases the drive surface forms also a moving surface of the retarding treatment zone, the said one stationary surface extending thereover and effecting the retardation; in others the drive surface delivers the web between a pair of stationary surfaces either or both of which may be roughened.

In order for the advantages of the present invention to be achieved, it is essential that the retarding force or surface roughness should both increase and decrease across the width of the retarding treatment zone. The value preferably oscillates a plurality of times across the width of the treatment zone, most preferably several times; in these cases, the oscillation is usually between substantially the same maxima and substantially the same minima, though this is not essential. The variation across the treatment zone may be continuous, or it may be incremental—e.g. with abrupt changes between rough and smooth surface portions alternating across the treatment zone.

The invention is illustrated, by way of example only, in the accompanying drawings, in which:

FIG. 1 is a very simplified schematic side elevation view of a known longitudinal compressive treatment machine of the type disclosed in U.S. Pat. No. 3,260,778;

FIG. 2 is a similar view of another known such machine of the type disclosed in U.S. Pat. No. 3,810,280;

FIG. 3 is a schematic plan view from below of the confining and retarder blades of the FIG. 2 machine;

FIGS. 4 to 9 are views similar to that of FIG. 3 illustrating modified retarder blades which may be used according to the invention in the FIG. 2 apparatus;

Figure 7:
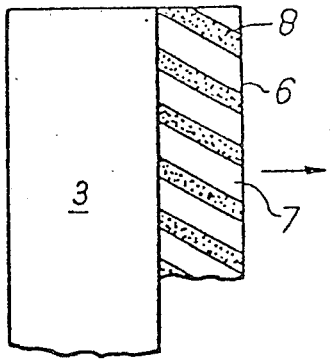
Figure 8:
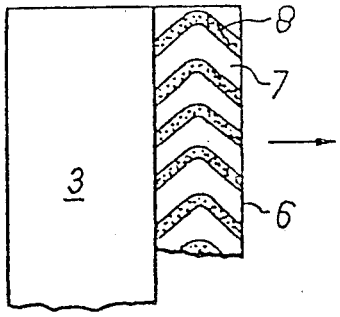
Figure 9:
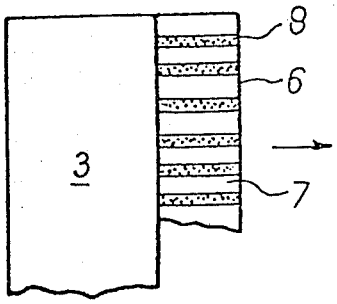

The known machines of FIGS. 1 and 2 each have a driving roll 1 onto which the web 2 to be treated is pressed by means of a confining surface 3. Roll 1 is relatively rough, whilst the confining surface 3 is relatively smooth. Rotation of the roll forces the web into a retarding treatment area. In FIG. 1 retardation takes place because of the retarding effect between a smooth flexible blade 4 and a rigid retarder blade 5. In FIG. 2 retardation takes place because of the friction between the web and a rather rough retarder 6.

The vertical arrows in FIGS. 1 and 2 indicate pressure applied to confining plate 3. Attention is directed to the two mentioned U.S. specifications for full detail of the structure and operation of these known machines. The flexible smooth retarder blade 4 of the above FIG. 1 type of machines in U.S. Pat. No. 3,260,778 may have a serrated downstream transverse end, but this does not impart any two-way properties to the product (see FIG. 11 of the U.S. specification). With the machines of U.S. No. 3,810,280 two-way properties such as two-way stretch are obtainable only by subjecting the web to two machine passes (column 17 lines 27 to 48) or, what amounts to the same thing, using a web which is already creped longitudinally (column 21 lines 39 to 47); this is uneconomic and unsatisfactory as the second machine pass will tend to obliterate the results of the first rather than complementing them and with many materials will be at best a difficult operation. FIG. 3 shows schematically the smooth confining blade 3 and the rough (dotted) underside of retarder blade 6, the horizontal arrow indicating the machine direction.

Throughout the various Figs. of the drawings (which are not to scale) like reference numerals denote like parts.

FIGS. 4 and 6 to 9 illustrate modified retarder blades 6 which can be used according to the invention in the FIG. 2 type of machine. In each case the retarder 6 has a working surface which is smooth in some parts (7) and relatively rough at other parts (8) so that the roughness, and therefore the friction, vary many times across the width of the machine. A similar effect is obtained with the retarder blade of FIG. 5. Many variations are possible within the invention; thus in FIGS. 4 to 6 the sinuous transverse boundaries may instead be of saw-tooth or square wave form or of any non-rectilinear form, and in FIG. 6 there may be one or more further transverse rough zones e.g. as indicated at 18.

Rough areas may be slightly out of the plane of the smooth(er) parts of the retarder. In these cases the boundaries are preferably slightly rounded-off.

Because the friction, or resistance to forward web movement, is varied across the width of the machine, those parts of the web meeting the highest friction drag behind those concurrently meeting lesser friction; the end result of this is the imparting of two-way properties (e.g. stretch) to the starting material.

In application of the present invention to machines of the type shown in FIG. 1, the smooth flexible retarder blade 4 of the prior art may be replaced by a flexible blade whose operating surface projecting downstream from confining plate 3 is of the same nature as proposed above for retarder blades 6 in the FIG. 2 arrangements according to the invention; the operating face of such a blade 4 according to the invention may, for example, be as illustrated for blade 6 of any of FIGS. 4 to 9. In other FIG. 1 embodiments according to the invention, the rigid plate 5 is provided with an operating surface whose roughness, over at least a portion of the length of the treatment zone, oscillates as required by the invention across the width of the zone; in yet further embodiments, the operating surfaces of both blades 4 and 5 may be so roughened, or may be roughened so that they together provide a retarding force on the web which oscillates across the width of the treatment zone.

Figure 10:
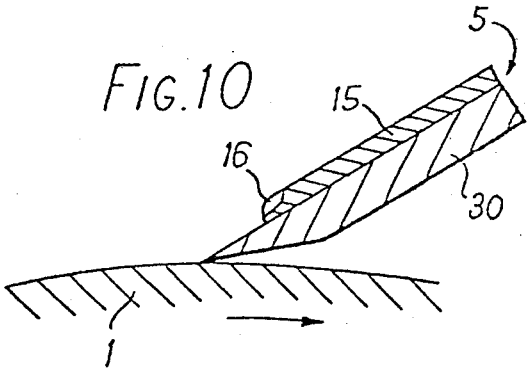
FIGS. 10 and 11 are respectively side elevation and partial plan views of a rigid retarder blade which may be employed according to the invention in a FIG. 1 type of apparatus.
Figure 11:
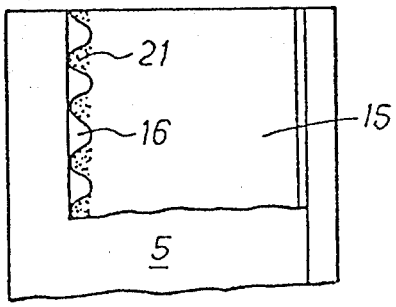
Figure 12:
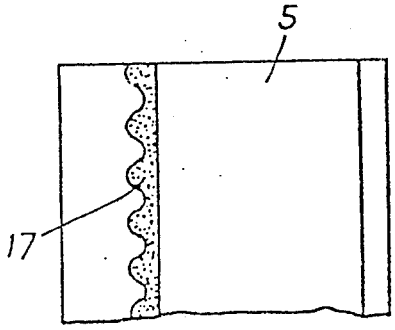
FIG. 12 is a view similar to that of FIG. 11 of another rigid retarder blade which can be employed according to the invention in the FIG. 1 type of machine.

FIGS. 10 and 11 illustrate one such blade 5 which may be used in the FIG. 1 machine according to the invention, this having a base plate 30 carrying a separate blade 15 which has small depressions 16 in its upstream edge located a little downstream from the leading edge of the composite blade 5; the crests between depressions 16 are rough as indicated at 21. FIG. 12 illustrates in plan view a simpler blade 5 usable according to the invention in the FIG. 1 machine, this being a unitary blade having a rough region 17 extending transversely thereacross downstream from its leading edge. In FIG. 1 embodiments according to the invention, it is preferred that the main retardation in the retarding treatment zone should occur downstream from the leading edge of blade 5 by providing the rough or roughened portion or portions of blade 4 and/or blade 5 only in the said downstream region.

The rough retarder surface employed according to the invention is readily provided in a number of simple ways. For example, the blade may be of steel or other metal which is sand-blasted or coated with hard particles where it is required to be rough. For example, the blades 6 of FIGS. 4 and 6 to 9 may be locally sand-blasted or embedded or coated with abrasive particles in the region or regions 8. A rough operating surface may also be provided by emery cloth or other bonded abrasive with a suitable supporting backing; retarder 6 of FIG. 5 may, e.g. be of emery cloth, backed up as described in U.S. Pat. No. 3,810,280; and retarder 6 of FIG. 6 may be a strip 8 of emery cloth on a very thin metal blade 7. Instead of emery cloth one may use rubber, resilient polyurethane, or other resilient plastics. The use of rubber, or other elastomer such as polyurethane, as a friction material can be extremely effective when treating latex-containing papers and non-wovens; with retarder blade like that of FIG. 6 which uses such material for the high friction region(s), an edge (or a protruding edge) of the order of one millimeter is usually enough to give two-way properties according to the invention.

When treating latex—or like binder—containing papers or non-wovens, a stable product can be obtained if the binder is not set before the start of the treatment according to the present invention; the heat in the machine can effect or finalise the setting.

It is claimed:

1. A method of treating a flexible web to uniquely compress the web and thereby impart a two way stretch to the web, said method comprising:
   (a) continuously driving a web longitudinally in and through a retarding treatment zone;
   (b) compressing the web in a retarding treatment zone between a pair of opposed surfaces, at least one of which is rough with respect to the other;
   (c) withdrawing the web in a longitudinal direction while restraining alternately spaced portions of the web to create a stretch property in the web that is transverse to the longitudinal direction;
   whereby the web, when withdrawn from the restraining area, will have a unique two dimensional stretch property.

2. A method for treating a flexible web as claimed in claim 1, said method further comprising the step of retaining alterante portions of the web in the compression zone by frictionally restraining alternating portions of the web with a retarding force that alternates between substantially equal maxima and minima forces.

3. A method of treating a flexible web as claimed in claim 2, wherein the web is frictionally engaged by periodic variations in the roughness of one of the pair of opposed surfaces.

4. A method of treating a flexible web as claimed in claims 1 or 2 or 3 wherein the web is driven into the retarding treatment zone by a drive surface onto which the web is pressed by a confining surface.

5. A method of treating a flexible web as claimed in claim 3 wherein the smooth surface in the treatment zone is formed on a driving surface, while the rough surface is terminated at the downstream end by alternating areas of roughness and smoothness.

6. A method of treating a flexible web as claimed in claim 3 wherein a doctor blade forms the rough surface of the retarding treatment zone.

7. An apparatus for treating a flexible web to uniquely compress the web and thereby impart a two way stretch to the web, said apparatus comprising:
   (a) a retarding treatment zone defined by closely spaced opposed surfaces, at least one of which is stationary for retardingly engaging the flexible web as it passes through the treatment zone;
   (b) a drive means for continuously advancing a longitudinal and flexible web into and through the retarding treatment zone;
   (c) means for restraining periodically spaced portions of the web as it is withdrawn from the retarding treatment zone, said spaced portions being spaced transverse to the longitudinal dimension of the web;

whereby the web, when withdrawn from the restraining area will have a unique two dimensional stretch property.

8. An apparatus for treating a web as claimed in claim 7, wherein the means for restraining the web comprises a downstream end to the retarding zone which has alternating periods of roughness and smoothness.

9. An apparatus for treating a web as claimed in claim 7 wherein the means for restraining the web generates a restraining force that alternates between substantially equal maxima and minima values.

10. An apparatus for treating a web as claimed in claim 7 or 8 or 9 wherein the means for restraining the web further comprises a nonrectilinear transverse boundary at the downstream end of the retarding treatment zone, said nonrectilinear transverse boundary having longitudinally adjacent and transversely displaced areas of roughness and smoothness.

11. An apparatus for treating a flexible web as claimed in claim 7 or 8 or 9 wherein the web is driven into the retarding treatment zone by a drive surface onto which the web is pressed by a confining surface.

12. An apparatus for treating a flexible web as claimed in claim 7 or 8 or 9 wherein one of the closely spaced opposed surfaces is smooth and provides a driving surface, the other of the closely spaced surfaces being determined at its downstream end by alternating periods of roughness and smoothness.

13. An apparatus for treating a flexible web as claimed in claim 10 wherein the transversely displaced areas of roughness are formed of sand blasted metal.

14. An apparatus for treating a web as claimed in claim 10 wherein the transversely displaced areas of roughness are formed of metal coated with abrasive particles.

15. An apparatus for treating a web as claimed in claim 10 wherein the transversely displaced areas of roughness are formed by coating portions of the blade with a material selected from one or more of the group of: rubber, resilient polyurethane and resilient elastomers.

* * * * *

UNITED STATES PATENT OFFICE

CERTIFICATE OF CORRECTION

Patent No. 4,432,926 Dated February 21, 1984

Inventor(s) Jan Van Tilburg

It is certified that error appears in the above-identified patent and that said Letters Patent are hereby corrected as shown below:

Column 6, line 7 "being determined at" should read --being terminated at--.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*